US009415323B2

(12) United States Patent
Austern et al.

(10) Patent No.: US 9,415,323 B2
(45) Date of Patent: Aug. 16, 2016

(54) CHILD ENTERTAINMENT APPARATUS AND INTERACTIVE DEVICE

(71) Applicant: Mattel, Inc., El Segundo, CA (US)

(72) Inventors: Inbal Paulina Austern, Buffalo, NY (US); Linda J. Chapman, Corfu, NY (US); Mary G. Mastrosimone-Gese, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/877,065

(22) Filed: Oct. 7, 2015

(65) Prior Publication Data

US 2016/0101369 A1 Apr. 14, 2016

Related U.S. Application Data

(60) Provisional application No. 62/061,306, filed on Oct. 8, 2014.

(51) Int. Cl.
*A63H 33/00* (2006.01)

(52) U.S. Cl.
CPC ..... *A63H 33/006* (2013.01); *A63H 33/003* (2013.01)

(58) Field of Classification Search
CPC ... A63H 33/006; A63B 2208/12; E04H 15/48
USPC ..... 446/227; 5/97, 416, 417, 655; 135/96, 135/135, 158; 482/23, 148
See application file for complete search history.

(56) References Cited

U.S. PATENT DOCUMENTS

| | | | | |
|---|---|---|---|---|
| 4,627,588 | A * | 12/1986 | Block | A63H 33/006 248/105 |
| 5,692,257 | A * | 12/1997 | Albertieri | A41B 13/06 5/494 |
| 5,788,253 | A * | 8/1998 | Thomson | A47D 13/00 280/47.38 |
| 6,332,824 | B2 | 12/2001 | Tell et al. | |
| 6,540,579 | B1 * | 4/2003 | Gubitosi | A63H 33/00 297/118 |
| 6,684,422 | B2 * | 2/2004 | LeFevre | A47G 9/0223 2/69 |
| 6,702,643 | B1 | 3/2004 | Drosendahl et al. | |
| 7,448,969 | B2 | 11/2008 | Weber et al. | |
| 7,530,909 | B2 | 5/2009 | Thomas et al. | |
| 8,460,053 | B2 | 6/2013 | Fair et al. | |
| 2005/0095948 | A1 | 5/2005 | Snyder et al. | |
| 2006/0199166 | A1 | 9/2006 | Snyder et al. | |
| 2006/0199467 | A1 * | 9/2006 | Snyder | A63H 33/006 446/227 |
| 2007/0066446 | A1 * | 3/2007 | Gelfond | A63B 21/4037 482/23 |

(Continued)

*Primary Examiner* — Nini Legesse
(74) *Attorney, Agent, or Firm* — Edell, Shapiro & Finnan, LLC

(57) ABSTRACT

A children's entertainment structure or play gym includes a first support member, a second support member, an arched member coupled to the top of the first support member and the top of the second support member, and a mat reconfigurable between the first and second support members and beneath the arched member. Moreover, each of the support members has an upper opening and an internal passageway that is in connection with the upper opening that extends through at least a portion of the support member. The upper opening and the passageway are sized and configured to receive and transport balls to the bottom of the support members. The arched member includes a channel that is also configured to receive balls, while allowing them to roll towards the upper openings on the support members.

14 Claims, 8 Drawing Sheets

(56) References Cited

U.S. PATENT DOCUMENTS

| | | | | |
|---|---|---|---|---|
| 2007/0122066 | A1* | 5/2007 | Landay | A47G 9/086 383/16 |
| 2011/0076912 | A1* | 3/2011 | Snyder | A63H 33/006 446/227 |
| 2011/0130225 | A1 | 6/2011 | Sims | |
| 2011/0154572 | A1 | 6/2011 | Fair et al. | |
| 2011/0156455 | A1 | 6/2011 | Fair et al. | |
| 2011/0163520 | A1 | 7/2011 | Fair et al. | |
| 2012/0073048 | A1* | 3/2012 | Ballard | A47G 9/062 5/485 |
| 2012/0083183 | A1 | 4/2012 | Zheng | |
| 2013/0280983 | A1 | 10/2013 | Fair et al. | |
| 2013/0280984 | A1 | 10/2013 | Fair et al. | |

* cited by examiner

CHILD ENTERTAINMENT APPARATUS AND INTERACTIVE DEVICE

CROSS REFERENCE TO RELATED APPLICATIONS

This application claims priority to and the benefit of U.S. Provisional Patent Application No. 62/061,306, filed Oct. 8, 2014, entitled "Reconfigurable Infant Play Yard," the contents of which are hereby incorporated by reference in their entirety.

FIELD OF THE INVENTION

The present invention relates to a gym that has multiple configurations to allow for use by newborns, infants and even toddlers. In particular, it relates to a children's gym including two support members, an activity bar, and a mat. The mat may be reconfigurable between multiple configurations for different styles of play that allow the gym to grow with the child. The activity bar may further include interactive toys such as hanging elements removably suspended from the activity bar, as well as lights and sounds to further engage the child.

BACKGROUND OF THE INVENTION

Very young children develop by interacting with their surrounding environment. Sensory stimuli are one of a newborn or infant's first sources of learning (infants learn through audio and visual stimulation related to different fields of experience). For example, seeing bright colors, bold patterns, and moving elements fosters development of visual tracking skills. Listening to music and sounds stimulates auditory skills, while touching materials of varying texture enhances tactile skills. Each of these activities, moreover, encourages these children to use and develop their cognitive skills to differentiate among various sights, sounds, and textures. Consequently, toys for very young children are often developed to create varied interactive, sensory experiences. For example, infant gyms enhance both visual and auditory skills through stimulation by providing an infant an opportunity to use his or her senses while interacting with the gym. Infant gyms provide neurological stimulation, as well as develop an infant's motor and cognitive skills. Specifically, an infant gym with enhanced visual appeal, different textures, and busy activities stimulates the infant's senses, and thus his or her sensory development. Furthermore, infant gyms encourage an infant to kick, reach, and bat at hanging toys, developing motor skills. In addition, the infant's ability to repeatedly make events happen helps an infant understand cause and effect. Increasing interaction with an infant gym is desirable because it increases the infant's potential for learning. However, most infant gyms are only affective at holding an infants attention when the infant is only capable of lying in the supine position, and lose much of their use when the child begins to sit, or ultimately stand. Once infants are able to sit, craw, and/or walk, other forms of entertainment beyond hanging items that they can kick, reach, and bat at while lying in the supine position are desireable to continue to develop the infant's motor and cognitive skills and add value to the consumer. Thus, it is desirable to provide an entertainment device or toy including activities with which a child can interact to develop cognitive and/or motor skills as they grow older.

The present invention is directed generally to an entertainment device or toy that is capable of being used throughout the growth of the child. What is needed is a gym that is capable of being used during all of the early growth stages of a child, from when a child is only capable of lying in the supine position, to when the child can sit upright unassisted, to when the child is able to stand and walk around. The desired gym may further include one or more interactive features such as hanging elements and ball placement and drop elements that can be utilized in the different configurations.

SUMMARY OF THE INVENTION

According to one exemplary embodiment, the present invention includes a gym containing a first support member, a second support member, a substantially horizontal member, and a mat. The first and second support members are oriented in a generally vertical orientation and spaced apart from one another. Moreover, the support members each have a top, a bottom, an opening disposed on the top, and an internal passageway in communication with the opening. The substantially horizontal member is coupled to the top of the first support member and the second support member proximate to the upper openings. Furthermore, a toy ball can be placed on the horizontal member and travel towards either of the upper openings. If the ball travels into either of the upper openings, the ball will travel along the internal passageway to the bottom of the support member. Finally, the mat is placeable between the first and second support members, and is be removably coupleable to the first and second support members in multiple configurations to change the orientation and shape of the mat for different types of play as a child grows.

BRIEF DESCRIPTION OF THE DRAWINGS

Like reference numerals have been used to identify like elements throughout this disclosure.

DETAILED DESCRIPTION OF THE INVENTION

Figure 1:
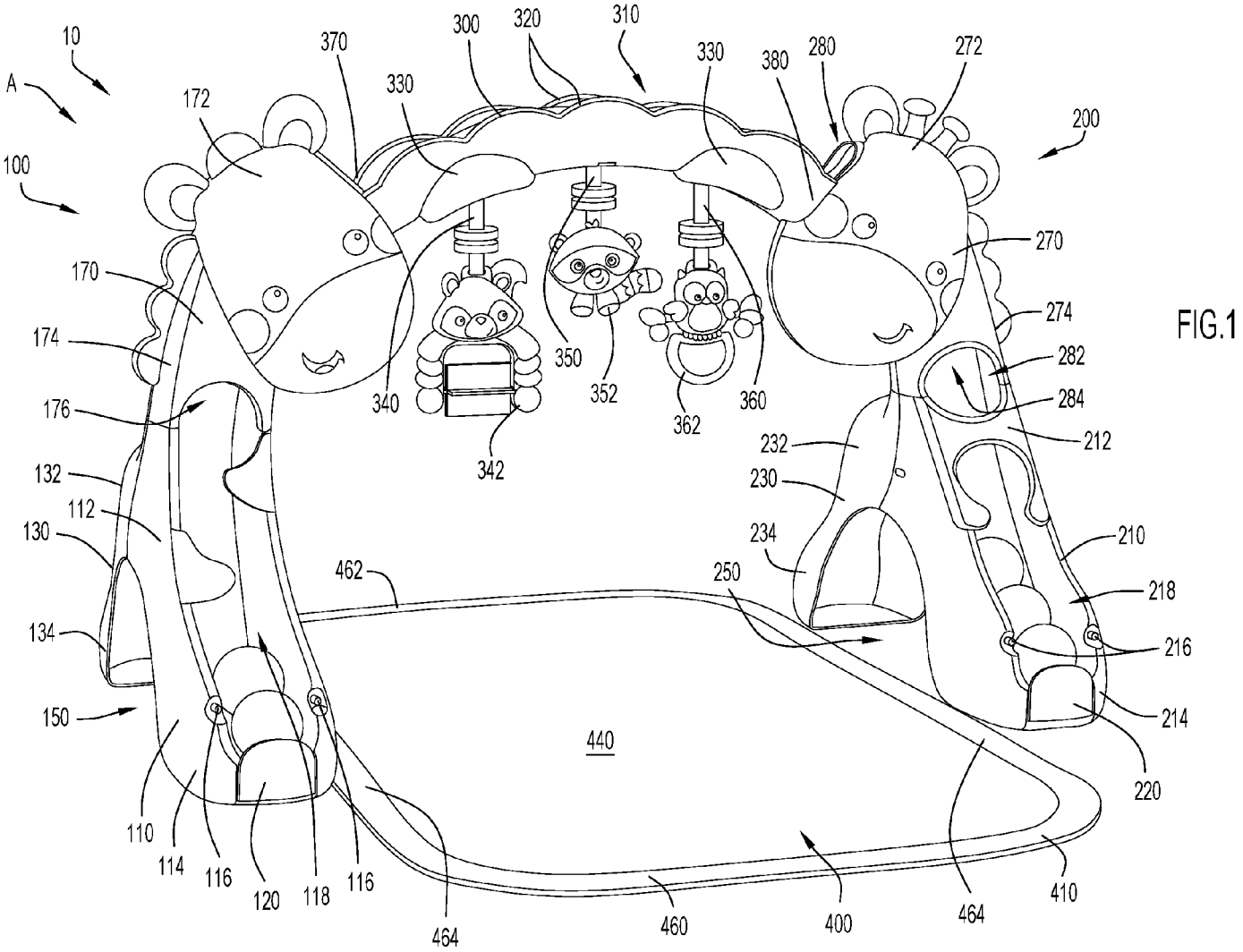
FIG. 1 illustrates a front view of a first embodiment of a gym in the first configuration according to the present invention.

Illustrated in FIGS. 1, 1A, 2, 2A, 2B, 2C, 3, and 4 is a gym 10, in accordance with the present invention, that is reconfigurable to provide different play features for a young child. The gym 10, as illustrated in FIGS. 1, 1A, 2, 2A, 2B, 2C, 3, and 4, includes a first support member 100, a second support member 200, and an arched member 300 connected to both the first support member 100 and the second support member 200. The first support member 100 includes a first leg 110, a second leg 130, and a upper member 170 that extends upwardly from the first and second legs 110, 130. The first leg 110 of the first support member 100 has a top portion 112 and a bottom portion 114 where the bottom portion 114 is configured to engage a support surface. The second leg 130 of the first support member 100 also has a top portion 132 and a bottom portion 134 where the bottom portion 134 is configured to engage a support surface. The top portion 112 of the first leg 110 is coupled to the top portion 132 of the second leg 130, while the bottom portion 114 of the first leg 110 is spaced away from the bottom portion 134 of the second leg 130. The first leg 110 and the second leg 130 of the first support member 100 together form an archway 150. Furthermore, the upper member 170 includes a top portion 172 and a bottom portion 174, where the bottom portion 174 is coupled to the top portions 112, 132 of the first and second legs 110, 130 of the first support member 100.

Additionally, as illustrated in FIGS. 1, 1A, 2, 2A, 2B, 2C, 3, and 4, the second support member 200 includes a first leg 210, a second leg 230, and a upper member 270 that extends upwardly from the first and second legs 210, 230. The first leg 210 of the second support member 200 has a top portion 212 and a bottom portion 214 where the bottom portion 214 is configured to engage a support surface. The second leg 230 of the second support member 200 also has a top portion 232 and a bottom portion 234 where the bottom portion 234 is configured to engage a support surface. Similarly to that of the first support member 100, the top portion 212 of the first leg 210 is coupled to the top portion 232 of the second leg 230, while the bottom portion 214 of the first leg 210 is spaced away from the bottom portion 234 of the second leg 230. The first leg 210 and the second leg 230 of the second support member 200 form an archway 250 identical to the archway 150 formed in the first support member 100. Furthermore, the upper member 270 includes a top portion 272 and a bottom portion 274, where the bottom portion 274 is coupled to the top portions 212, 232 of the first and second legs 210, 230 of the second support member 200.

Figure 2:
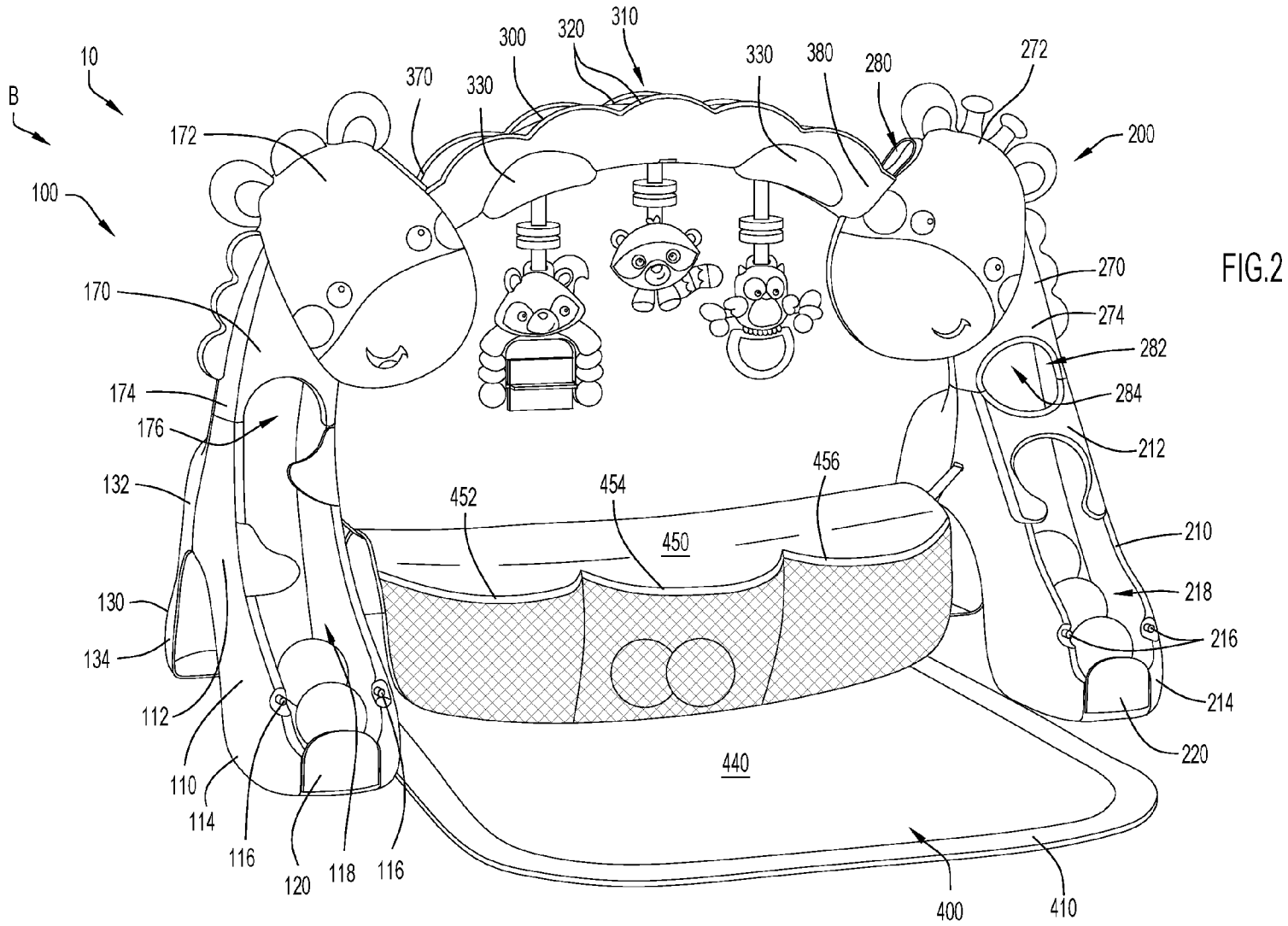
FIG. 2 illustrates a front view of the first embodiment of the gym illustrated in FIG. 1, the gym being configured in the second configuration.
Figure 3:
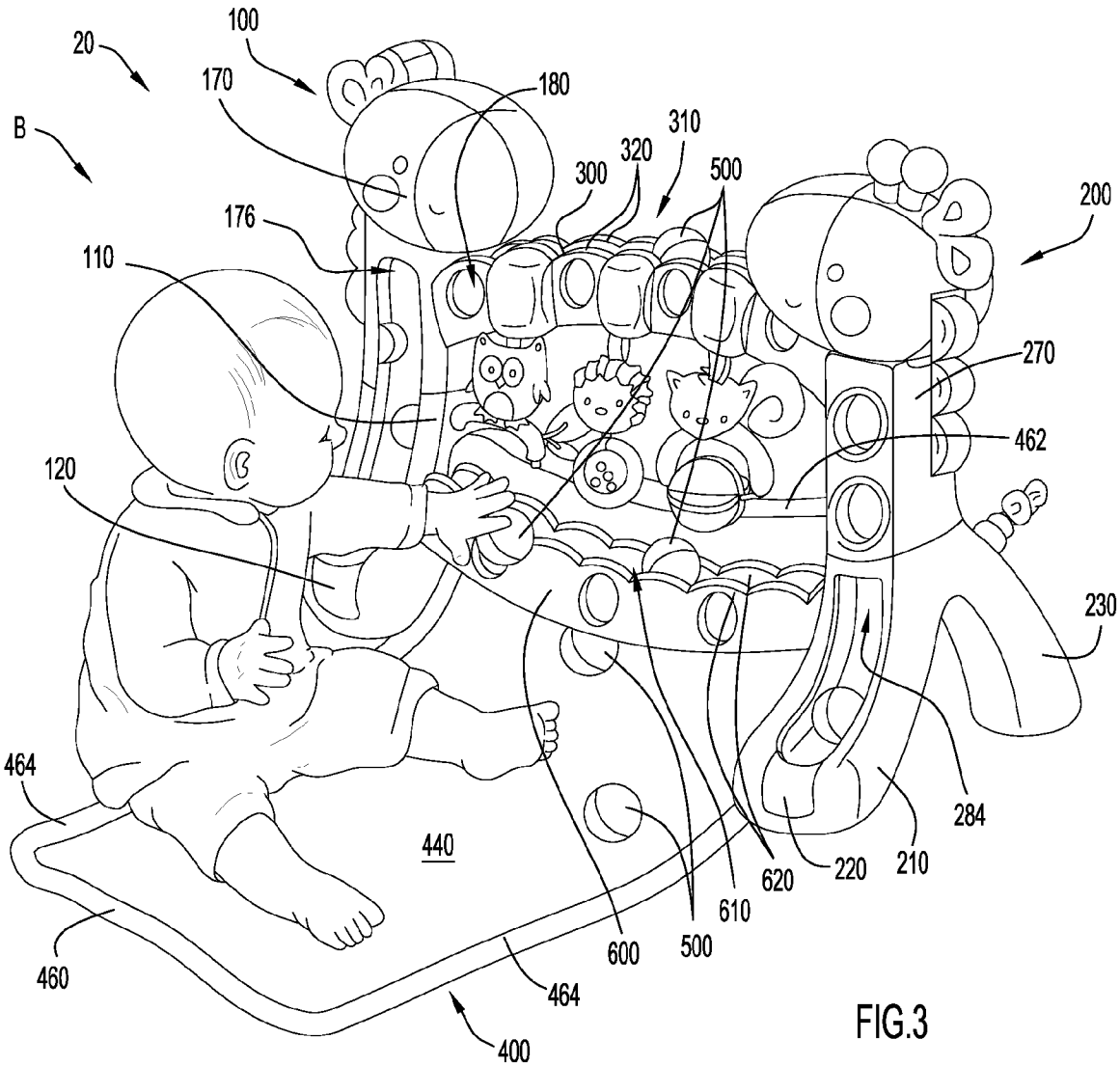
FIG. 3 illustrates a perspective view of a second embodiment of a gym in the second configuration according to the present invention.

The top portion 172 of the upper member 170 of the first support member 100 includes an opening 180 (best seen in FIG. 3). The upper member 170 further includes a passageway 176 that runs through the interior of the upper member 170 from the opening 180 in the top portion 172 through the bottom portion 174 of the upper member 170. Furthermore, the first leg 110 of the first support member 100 contains a channel 118 that runs from the top portion 112 of the first leg 110 to the bottom portion 114 of the first leg 110 down the front of the leg 110. The passageway 176 of the upper member 170 opens into the channel 118 of the first leg 110 creating a continuous pathway from the opening 180 in the top portion 172 of the upper member 170 to the bottom portion 114 of the first leg 110. A ball 500 that enters the opening 180 in the top portion 172 of the upper member 170 would travel through the passageway 176 of the upper member 170 and then down the channel 118 of the first leg 110 to the bottom portion 114 of the first leg 110. The bottom portion 114 of the first leg 110 further includes a repositionable gate 120 that, when in the closed position illustrated in FIGS. 1-3, prevents any balls 500 from exiting the channel 118 of the first leg 110. The bottom portion 114 of the first leg 110 of the first support member 100 further includes projections 116 positioned on either side of the channel 118 proximate the gate 120.

Figure 4:
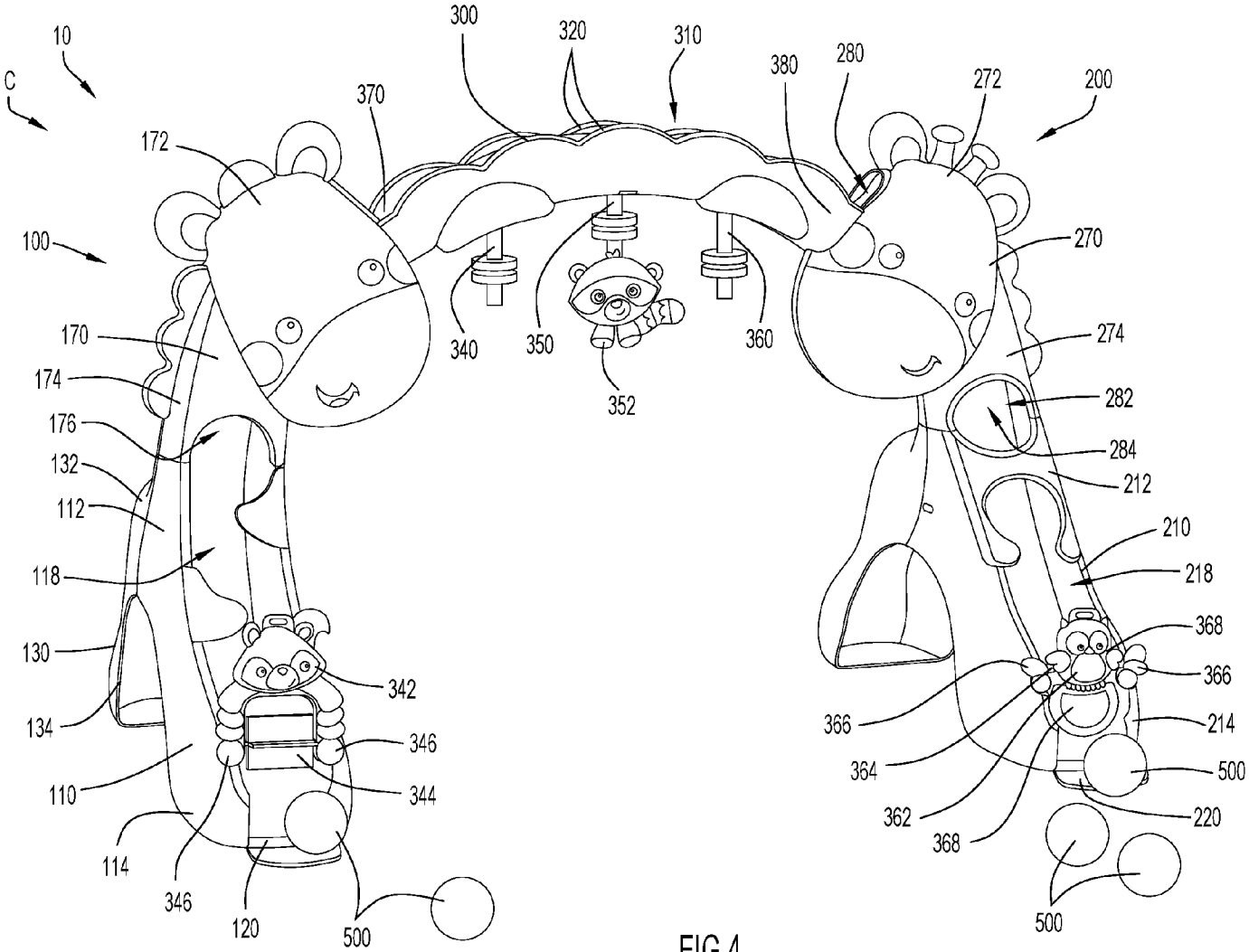
FIG. 4 illustrates a front view of the first embodiment of the gym illustrated in FIG. 1, the gym being configured in a third configuration.

Similar to the upper member 170 of the first support member 100, the top portion 272 of the upper member 270 of the second support member 200 includes an upper opening 280 (best seen in FIGS. 1, 2, and 4). The upper member 270 further includes a passageway 284 that runs through the interior of the upper member 270 from the upper opening 280 in the top portion 272 through the bottom portion 274 of the upper member 270. Furthermore, the first leg 210 of the second support member 200 contains a channel 218 that runs from the top portion 212 of the first leg 210 to the bottom portion 214 of the first leg 210 down the front of the first leg 210. The passageway 284 of the upper member 270 opens into the channel 218 of the first leg 210 creating a continuous pathway from the opening 280 in the top portion 272 of the upper member 270 to the bottom portion 214 of the first leg 210. A ball 500 that enters the opening 280 in the top portion 272 of the upper member 270 would travel through the passageway 284 of the upper member 270 and then down the channel 218 of the first leg 210 to the bottom portion 214 of the first leg 210. The upper member 270 of the second support member 200 further includes a lower opening 282 that is disposed on the sidewall of the upper member 270 proximate to the bottom portion 214. The lower opening 282 is in communication with the passageway 284 and the channel 218, so that a ball 500 placed in the lower opening 282 would also travel down the passageway 284 and into the channel 218 of the first leg 210. Moreover, the bottom portion 214 of the first leg 210 of the second support member 200 further includes a repositionable gate 220 that, when in the closed position illustrated in FIGS. 1-3, prevents any balls 500 that travel down the channel 218 from exiting the channel 218 of the first leg 210. The bottom portion 214 of the first leg 210 of the second support member 200 further includes projections 216 positioned on either side of the channel 218 proximate the gate 220.

Figure 1A:
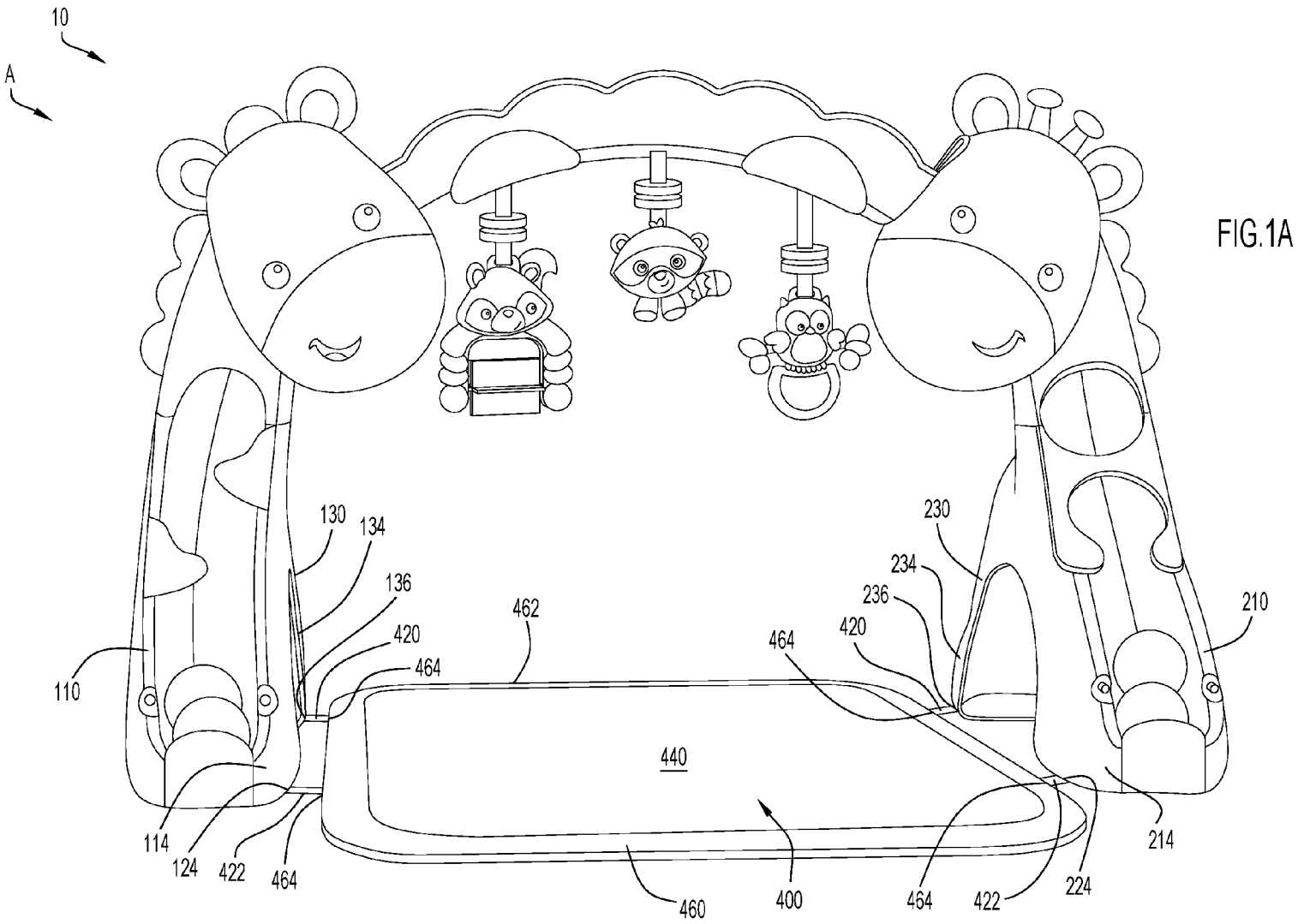
FIG. 1A illustrates a front view of the connection of the mat to the first and second support members of the first embodiment of the gym illustrated in FIG. 1, the gym being configured in the first configuration.
Figure 2A:
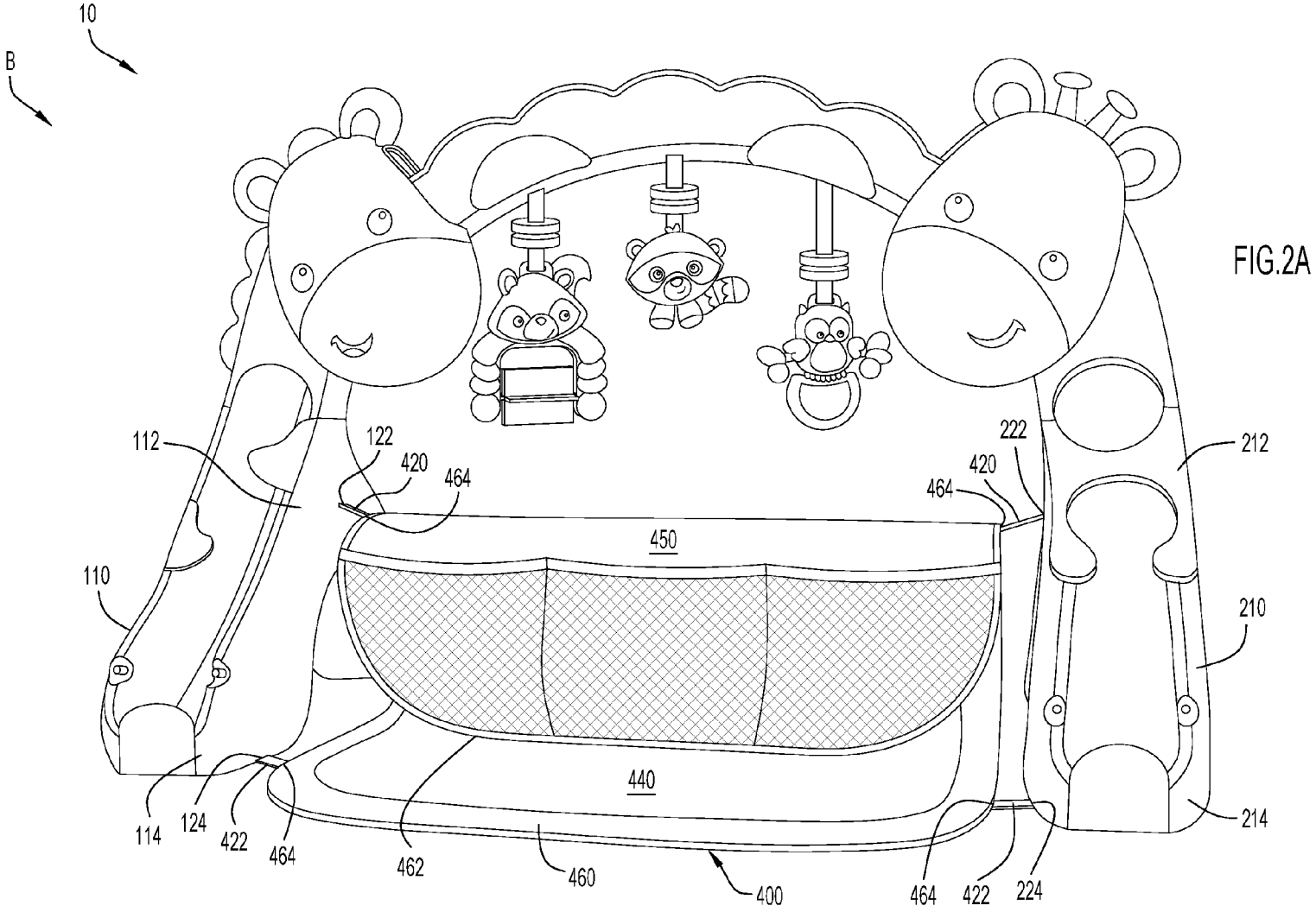
FIG. 2A illustrates a front view of the connection of the mat to the first and second support members of the first embodiment of the gym illustrated in FIG. 2, the gym being configured in the second configuration.

As best illustrated in FIGS. 1A and 2A, the first support member 100 includes at least three small apertures 122, 124, and 136. Disposed on the first leg 110 of the first support member 100, proximate to the bottom portion 114 of the first leg 110, is a first aperture 124. Similarly, disposed on the second leg 130 of the first support member 100, proximate to the bottom portion 134 of the second leg 130, is a second aperture 136. Additionally, disposed on the first leg 110 of the first support member 100, proximate to the top portion 112 of the first leg 110, above the archway 150, is a third aperture 122. Mirroring the first support member 100, the second support member 200 includes at least three small apertures 222, 224, and 236. Disposed on the first leg 210 of the second support member 200, proximate to the bottom portion 214 of the first leg 210, is a first aperture 224. Disposed on the second leg 230 of the second support member 200, proximate to the bottom portion 234 of the second leg 230, is a second aperture 236. Finally, disposed on the first leg 210 of the second support member 200, proximate to the top portion 212 of the first leg 210, above the archway 250, is a third aperture 222.

As further illustrated in FIGS. 1, 1A, 2, 2A, 2B, 2C, 3, and 4, the arched member 300 includes a first end 370 and a second end 380. The first end 370 of the arched member 300 is coupled to the top portion 172 of the upper member 170 of the first support member 100 proximate the opening 180 in the top portion 172. Furthermore, the second end 380 of the arched member 300 is coupled to the top portion 272 of the upper member 270 of the second support member 200 proximate the upper opening 280 in the top portion 272. As further illustrated, the bottom of the arched member 300 includes two lights 330. In other embodiments, the number of lights 330 may vary, or the arched member 300 may include no lights. The bottom of the arched member 300 also is configured to receive and suspend a first tether 340, a second tether 350, and a third tether 360. Attached to the end of the first tether 340 is a first toy 342, attached to the end of the second tether 350 is a second toy 352, and attached to the end of the third tether 360 is a third toy 362. Other embodiments of the gym 10 may include more or less tethers with toys attached to them.

FIGS. 1, 1A, 2, 2A, 2B, 2C, 3, and 4 further illustrate that the arched member 300 includes a pair of sidewall members 320 that together define a channel 310 therebetween. The channel 310 is configured to rollingly receive balls 500. Because the arched member 300 has a curve where the highest point, or apex, of the curve is in the middle of the arched member 300, a ball 500 placed within the channel 310 of the arched member 300 will roll towards the first side 370 or the second side 380 of the arched member 300. Because the first side 370 of the arched member 300 is coupled to the top portion 172 of the upper member 170 proximate to the opening 180, a ball 500 that travels along the channel 310 of the arched member 300 toward the first side 370 of the arched member 300 would roll into the opening 180, and as explained previously, would eventually travel to the bottom portion 114 of the first leg 110 of the first support member 100. Similarly, because the second side 380 of the arched member 300 is coupled to the top portion 272 of the upper member 270 proximate to the upper opening 280, a ball 500 that travels along the channel 310 of the arched member 300 toward the second side 380 of the arched member 300 would roll into the upper opening 280, and as explained previously, the ball 500 would eventually travel to the bottom portion 214 of the first leg 210 of the second support member 200.

Furthermore, illustrated in FIGS. 1, 1A, 2, 2A, 2B, 2C, and 3 is a mat 400 (which may be formed from a softgoods material) that can be positioned between the first support member 100 and the second support member 200 and beneath the arched member 300. The mat 400 in the embodiments illustrated is substantially rectangular in shape. In other embodiments, the mat 400 may be of a different shape, such as a circle, a square, a triangle, etc. The mat 400 has a first end 460, a second end 462 opposite the first end 460, and sides 464 that connect the first end 460 with the second end 462. Because the mat 400 is in the shape of a rectangle, the sides 464 are longer in length than the first end 460 and the second end 462. The mat 400 is positioned underneath the arched member 300 and between the first support member 100 and the second support member 200 so that the sides 464 are positioned proximate to the first legs 110, 210 and the second legs 130, 230 of the first and second support members 100, 200. Moreover, as illustrated, the first end 460 is positioned proximate to the first legs 110, 210 of the first and second support members 100, 200, while the second end 462 is positioned proximate to the second legs 130, 230 of the first and second support members 100, 200. The mat 400 also includes a top surface 440 and a bottom surface 450 (illustrated in FIGS. 2, 2A, 2B, and 2C). As best shown in FIGS. 1A and 2A, the mat 400 includes a pair of tethers 422 that extend outward from the sides 464 proximate to the first end 460. The mat 400 additionally includes a second pair of tethers 420 that extend outward from the sides 464 proximate to the second end 462. In other embodiments, pairs of tethers 420, 422 may be in another form, such as the connectors 430 illustrated in FIGS. 2B and 2C, where the connectors 430 include tabs 432. In yet other embodiments, the mat 400 may include fabric loops, string, straps (e.g., straps where the ends are sewn in a T formation to retain the strap within an aperture), plastic or metal buttons or hooks, or other similar attachment means to attach the mat 400 to the first support member 100 and the second support member 200. In other embodiments, additional pairs of tethers may also be included.

Turning to FIG. 1, illustrated is the gym 10 in the first configuration A. In the first configuration A, the mat 400 is placed flat on the support surface with the top surface 440 facing upwards and the bottom surface 450 placed against the support surface. As previously explained, the mat 400 is positioned underneath the arched member 300 and between the first support member 100 and the second support member 200 so that the sides 464 are positioned proximate to the first legs 110, 210 and the second legs 130, 230 of the first and second support members 100, 200. As best illustrated in FIG. 1A, the mat 400 is secured to the first and second support members 100, 200 via the tethers 420, 422. FIG. 1A illustrates that, when the gym 10 is in the first configuration A, the first tethers 422 are inserted into the first apertures 124, 224 on the first legs 110, 210 of the first and second support members 100, 200, respectively. Furthermore, the second tethers 420 are inserted into the second apertures 136, 236 on the second legs 130, 230 of the first and second support members 100, 200, respectively. The insertion of the tethers 420, 422 into the apertures 124, 136, 224, 236 couples the mat 400 to the first and second support members 100, 200. The tethers 420, 422 may contain ends that are capable of being inserted into the first and second apertures 124, 136, 224, 236 and are configured to prevent the tethers 420, 422 from accidentally sliding out of engagement with the apertures 124, 136, 224, 236. The ends of the tethers 420, 422 may then, when desired, be slid out through the first and second apertures 124, 136, 224, 236 to decouple the tethers 420, 422, and subsequently the mat 400, from the first and second support members 100, 200.

The first configuration A is configured for an infant to lie in the supine position atop the mat 400 between the first and second support members 100, 200 and underneath the arched member 300. As previously stated, hanging from the arched member 300 are first tether 340, second tether 350, and third tether 360, which include first toy 342, second toy 352, and third toy 362, respectively. By way of example, the hanging toys 342, 352, 362 may include a character comprising a head portion, a torso portion, and/or a leg portion. By way of further example, the characters may be stylized as domestic animals (e.g., a cat or a dog), wild animals (e.g., a raccoon, owl), comic book characters, cartoon characters, and/or humanoid figures. The hanging toys 342, 352, 362 may further include various colors, may be made of any suitable material (including teethable material), and may include materials having varying textures. The hanging toys 342, 352, 362 may further include noisemakers such as squeakers and rattles, as well as other entertainment features including, but not limited to, spinning portions, mirrors, lights, etc. The tethers 340, 350, 360 allow the hanging toys 342, 352, 362 to hang from the arched member 300 a distance that would encourage an infant to kick, reach, and bat at the hanging toys 342, 352, 362 while the infant is lying in the supine position. Finally, the balls 500 may remain stored in the channels 118, 218 of the first legs 110, 210 of the first and second support members 100, 200 by way of the gates 120, 220 being positioned in the closed position.

Turning to FIG. 2, illustrated is the first embodiment of the second configuration B of the gym 10. This second configuration B may be utilized by an infant once the infant is able to crawl and sit up without any additional support. In this second configuration, the mat 400 has been folded over so that the second end 462 of the mat 400 is positioned closer to the first end 460, while also exposing a portion of the bottom side 450 of the mat 400. Moreover, as best illustrated in FIG. 2A, the mat 400 is secured to the first and second support members 100, 200 via the tethers 420, 422. Similar to the first configuration A, when the gym 10 is in the second configuration B, the first tethers 422 are inserted into the first apertures 124, 224 on the bottom portion 114, 214 of the first legs 110, 210 of the first and second support members 100, 200, respectively. However, as illustrated in FIG. 2A, the second tethers 420 are inserted into the third apertures 122, 222 on the top portion 112, 212 of the second legs 130, 230 of the first and second support members 100, 200, respectively. As previously explained, the insertion of the tethers 420, 422 into the apertures 122, 124, 222, 224 couples the mat 400 to the first and second support members 100, 200. The ends of the tethers 420, 422 may be configured to either lock the tethers 420, 422 into engagement with the apertures 122, 124, 222, 224 or slide out through the apertures 122, 124, 222, 224 to decouple the tethers 420, 422 from the first and second support members 100, 200.

As illustrated in FIGS. 2 and 2A, with the second pair of tethers 420 coupled to the third apertures 122, 222, a portion of the mat 400 proximate to the second end 462 has been lifted off of the support surface and folded over. In this position, the second end 462 is hanging downwards from the coupling of the second pair of tethers 420 to the third apertures 122, 222 so that the second end 462 of the mat 400 is touching the top surface 440 of the mat 400. Furthermore, the bottom surface 450 of the mat 400, proximate the second end 462 is a first pocket 452, a second pocket 454, and a third pocket 456. The pockets 452, 454, 456 may be mesh pockets (for example sewn on the bottom surface 450 of the mat 400). As illustrated, in the position of the mat 400 when the gym is in the second configuration B, the pockets 452, 452, 456 are substantially vertically oriented for the put and take placement of balls 500 into the pockets 452, 452, 456. This second configuration B encourages an infant to sit on the top surface 440 of the mat 400 and remove balls 500 from the channels 118, 218 of the first legs 110, 210 of the first and second support members 100, 200 and place them in the pockets 452, 452, 456.

Figure 2B:
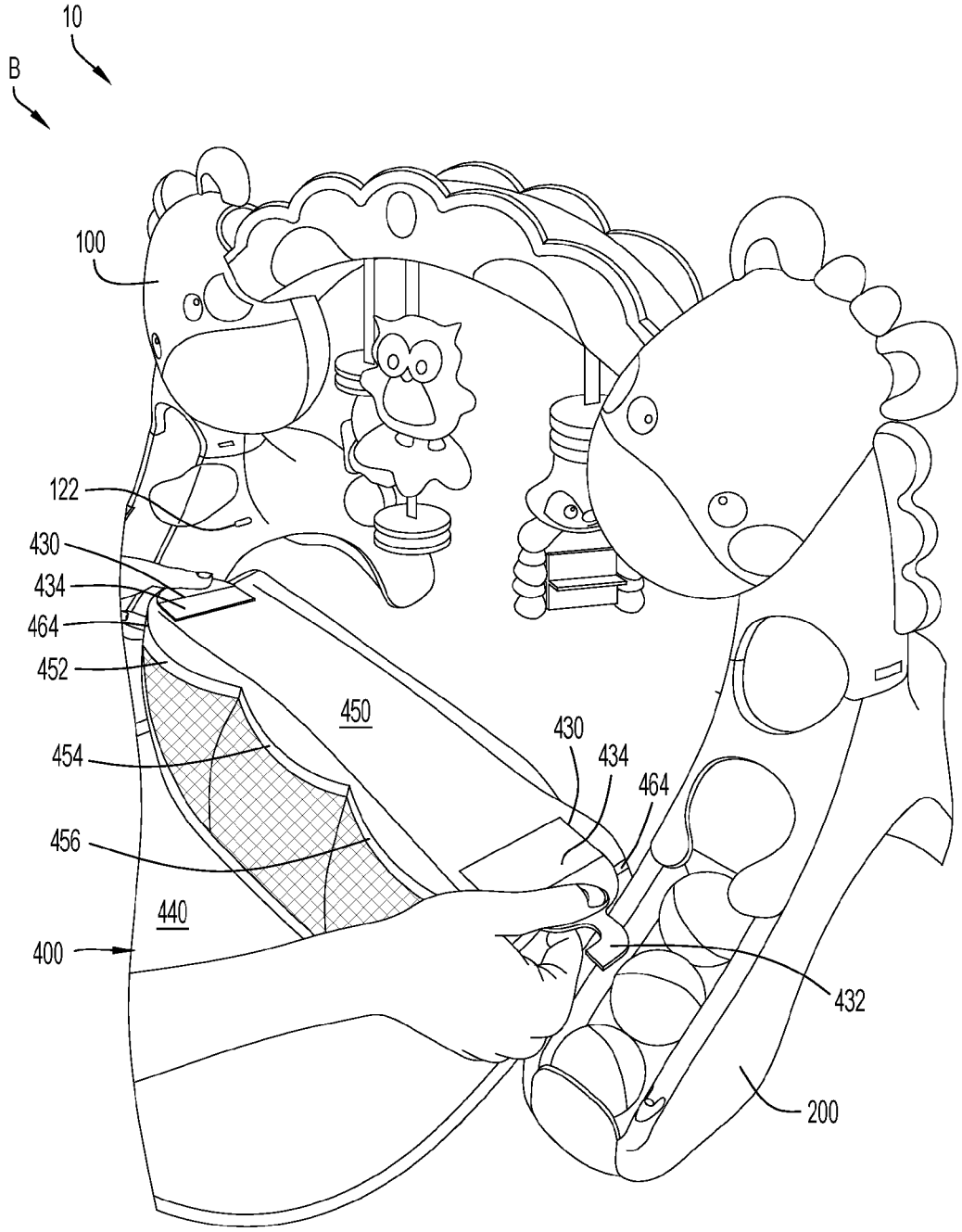
FIG. 2B illustrates a perspective view of a second embodiment of the connectors of the mat of the gym illustrated in FIG. 2, the gym being configured in the second configuration.
Figure 2C:
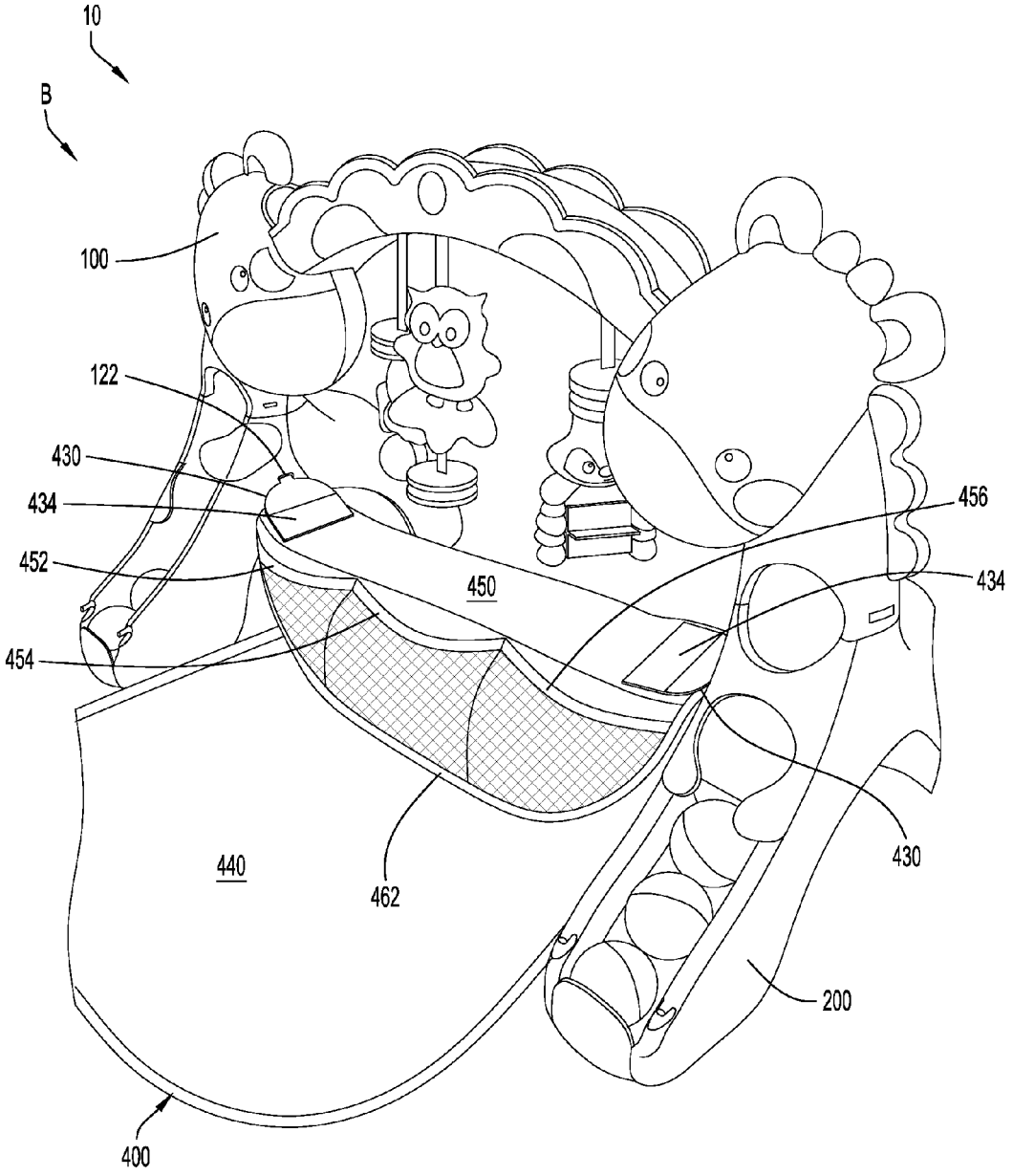
FIG. 2C illustrates a perspective view of a second embodiment of the connectors of the mat illustrated in FIG. 2B connected to the first and second support members of the gym illustrated in FIG. 2, the gym being configured in the second configuration.

FIGS. 2B and 2C illustrate a second embodiment of the mat 400, the mat 400 being positioned in the second configuration B. Instead of the mat 400 having tethers 420, as illustrated in FIGS. 2 and 2A, this second embodiment of the mat 400 includes connectors 430 attached to the bottom surface 450 of the mat 400 proximate to the sides 464. As best illustrated in FIG. 2B, the connectors 430 include a tab 432 and a base 434. The tab 432 and the base 434 are substantially rigid. As best illustrated in FIG. 2B, the tab 432 is substantially L-shaped. As best illustrated in FIG. 2C, the tabs 432 are inserted into the third apertures 122, 222 allowing the second end 462 of the mat 400 to be folded over and touching the top surface 440 of the mat 400. As previously explained, the bottom surface 450 of the mat 400, proximate the second end 462 has a first pocket 452, a second pocket 454, and a third pocket 456. Moreover, as best illustrated in FIG. 2C, because of the width and rigidity of the bases 434 of the connectors 430, the bottom surface 450 of the mat 400 forms a shelf-like top surface that extends between the connectors 430 proximate to the pockets 452, 454, and 456.

Referring to FIG. 3, illustrated is a second embodiment of a gym 20 with the gym 20 in the second configuration B. As previously discussed, this second configuration B may be utilized by an infant once the infant is able to crawl and sit up without any additional support. Similar to the first embodiment, the second end 462 of the mat 400 has been partially lifted off of the support surface (but not folded over). While not illustrated in FIG. 3, the second end 462 of the mat 400 is attached to the first support member 100 and the second support member 200 utilizing similar engagement mechanisms to those of the pairs of tethers 420, 422 and the first and third apertures 122, 124, 222, 224 illustrated in FIG. 2. With the second end 462 of the mat 400 connected to the first and second support members 100, 200, as illustrated in FIG. 3, the mat 400 forms a curved surface. Moreover, this second embodiment of the gym 20 in the second configuration B includes a lower arched member 600 coupled to the first leg 110 of the first support member 100 and the first leg 210 of the second support member 200. Opposite of that of the arched member 300, the lower arched member 600 is curved where the lowest point on the lower arched member 600 is in the middle. However, similar to that of the arched member 300, the lower arched member 600 has sidewalls 620 that define a channel 610 therebetween configured to receive balls 500. The infant is encouraged to sit on the mat 400 and throw or place balls 500 into the channel 610 of the lower arched member 600. Any balls 500 that do not make it into the channel 610 of the lower arched member 600 will be returned to the infant by rolling down the curved mat 400.

Turning to FIG. 4, illustrated is the gym 10 in the third configuration C. This third configuration C may be utilized by an infant once the infant is able to stand and walk without any additional support. As illustrated in FIG. 4, the mat 400 has been removed from between the first and second support members 100, 200 and from beneath the arched member 300. Furthermore, the first toy 342 has been removed from the first tether 340 and coupled to the projections 116 on the bottom portion 114 of the first leg 100 of the first support member 100, proximate to the gate 120. In addition, the gate 120 has been repositioned to the open position, allowing any balls 500 that travel down the channel 118 of the first leg 110 to travel out of the first leg 110 of the first support member 100. Similarly, the third toy 362 has been removed from the third tether 360 and coupled to the projections 216 on the bottom portion 214 of the first leg 200 of the second support member 200, proximate to the gate 220. The gate 220 of the second support member 200 has also been repositioned to the open position to allow any balls 500 that travel down the channel 218 and out of the first leg 210 of the second support member 200.

As further illustrated, the first toy 342, when attached to the projections 116, forms an archway proximate the end of the channel 118, near the gate 120 of the first support member 100. The first toy 342 is generally U-shaped with ends 346 that attach to the projections 116. Moreover, the first toy 342 includes a paddle wheel 344 that spans from one end 346 to the other end 346. The paddle wheel 344 is configured to spin about a generally horizontal axle. Therefore, when attached to the projections 116, the paddle wheel 344 is positioned in the pathway of the channel 118, and any balls 500 that travel out of the channel 118 will strike the paddle wheel 344, causing the paddle wheel 344 to spin. When the paddle wheel 344 is spun, the first toy 342 may output a noise, such as ratcheting or rattling noises.

Additionally, the third toy 362 includes an axle 364 with ends 366 that are attached to the projections 216. The axle 364 of the third toy 362 extends through the body 368 of the third toy 362, where the body 368 of the third toy 362 may be configured to spin about the horizontal axis of the axle 364. When the third toy 362 is coupled to the projections 216 of the first leg 210 of the second support member 200, the body of the third toy 362 is at least partially positioned in the pathway of the channel 218 of the second support member. Therefore, when balls 500 travel down the channel 218, the balls 500 will strike the body 368, causing the body 368 of the third toy 362 to spin. When the body 368 is spun, the third toy 362 may output a noise, such as ratcheting or rattling noises.

When in the third embodiment C, the infant is encouraged to place balls 500 into the channel 310 of the arched member or into the lower opening 282 of the second support member 200. As previously explained, a ball 500 that travels along the channel 310 of the arched member 300 toward the first side 370 of the arched member 300 would travel into the opening 180, through the passageway 176, down channel 118, and out the first support member 100 while spinning the paddle wheel 344 of the first toy 342 on its way out of the channel 118. Similarly, a ball 500 that travels along the channel 310 of the arched member 300 toward the second side 380 of the arched member 300 would travel into the upper opening 280, through the passageway 276, down the channel 218, and out of the second support member 200 while spinning the body 368 of the third toy 362 on its way out of the channel 218. A ball 500 placed into the lower opening 282 would travel through the remainder of the passageway 276, into the channel 218, and out of the second support member 200 while also spinning the body 368 of the third toy 362 on its way out of the channel 218. The first toy 342 and the third toy 362 may be interchangeable in locations. Furthermore, in other embodiments, toys may always be positioned near the bottom portion 114, 214 of the first legs 110, 210 of the support members 100, 200. Additionally, in other embodiments, additional toys can be placed near the outer and upper portions of support members 100 and 200 that, while not necessarily accessible to the younger baby in the supine position, would increase entertainment options for older toddlers who are able to walk around gym 10 or 20.

It is also to be understood that the gym of the present invention, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A child's gym comprising:

a first support member extending upwards from a supporting surface and including a top, a bottom, an opening disposed near the top, a pathway disposed inside the first support member and connecting the opening to the bottom, and a gate disposed near the bottom and having a first position and a second position, wherein the pathway allows an object placed by a child into the opening to travel along the pathway to the bottom of the first support member, the gate in the first position restricting the object travelling along the pathway from leaving the first support member, and the gate in the second position allowing the object travelling along the pathway to leave the first support member near the bottom;

a second support member extending upwards from the supporting surface;

an activity bar coupled to the first and second support members, the first and second support members positioning the activity bar above the supporting surface to create a child receiving area beneath the activity bar; and a mat coupled to at least one of the first and second support members and contacting the supporting surface, at least a portion of the mat configured to receive the child thereon;

wherein the mat is reconfigurable in at least two configurations:

a first configuration in which the mat is positioned substantially horizontally with respect to the supporting surface to receive the child in a supine position; and a second configuration in which only a first portion of the mat is positioned substantially horizontally with respect to the supporting surface and a second portion of the mat is positioned above the first portion of the mat, the first portion of the mat configured to receive the child in a seated position.

2. The child's gym of claim 1 wherein the mat is removably coupled to at least one of the first and second support members.

3. The child's gym of claim 1 wherein the mat has a first side and a second side, the first side of the mat facing the supporting surface in the first configuration, and a portion of the first side of the mat facing away from the supporting surface in the second configuration.

4. The child's gym of claim 3 wherein the first side of the mat includes at least one pocket configured for receiving objects, the at least one pocket being hidden from the child in the first configuration but exposed to the child in the second configuration.

5. The child's gym of claim 1 wherein in the second configuration, the second portion of the mat forms a shelf-like top surface above the first portion of the mat and the supporting surface.

6. A child's gym comprising:

a first support member extending upwards from a supporting surface and including a top, a bottom, an opening disposed near the top, a pathway disposed inside the first support member and connecting the opening to the bottom, and a gate disposed near the bottom and having a first position and a second position, wherein the pathway allows an object placed by a child into the opening to travel along the pathway to the bottom of the first support member, the gate in the first position restricting the object travelling along the pathway from leaving the first support member, and the gate in the second position allowing the object travelling along the pathway to leave the first support member near the bottom;

a second support member extending upwards from the supporting surface;

an activity bar coupled to the first and second support members, the first and second support members positioning the activity bar above the supporting surface to create a child receiving area beneath the activity bar; and a mat positioned between the first and second support members and contacting the supporting surface, at least a portion of the mat configured to receive the child thereon;

wherein the mat is reconfigurable in at least two configurations:

a first configuration in which the mat is coupled to at least one of the first and second support members and positioned substantially horizontally with respect to the supporting surface to receive the child in a supine position; and a second configuration in which the mat is coupled to at least one of the first and second support members and in which only a first portion of the mat is positioned substantially horizontally with respect to the supporting surface and a second portion of the mat is positioned in a non-horizontal and non-child receiving position.

7. The child's gym of claim 6 wherein the mat is removably coupled to at least one of the first and second support members.

8. The child's gym of claim 6 wherein the mat has a first side and a second side, the first side of the mat facing the supporting surface in the first configuration, and a portion of the first side of the mat facing away from the supporting surface in the second configuration.

9. The child's gym of claim 8 wherein the first side of the mat includes at least one pocket configured for receiving objects, the at least one pocket being hidden from the child in the first configuration but exposed to the child in the second configuration.

10. The child's gym of claim 6 wherein in the second configuration, a third portion of the mat forms a shelf-like top surface above the first portion of the mat and the supporting surface.

11. A child's gym comprising:

a first support member extending upwards from a supporting surface and including a top, a bottom, an opening disposed near the top, a pathway disposed inside the first support member and connecting the opening to the bottom, and a gate disposed near the bottom and having a first position and a second position;

a second support member extending upwards from the supporting surface;

an activity bar coupled to the first and second support members, the first and second support members positioning the activity bar above the supporting surface to create a child receiving area beneath the activity bar, wherein an object placed by a child into a channel in the activity bar travels through the opening and along the pathway to the bottom of the first support member, the gate in the first position restricting the object travelling along the pathway from leaving the first support member, and the gate in the second position allowing the object travelling along the pathway to leave the first support member near the bottom; and a mat coupled to at least one of the first and second support members and contacting the supporting surface, at least a portion of the mat configured to receive the child thereon;

wherein the mat is reconfigurable in at least two configurations:

a first configuration in which the mat is positioned to receive the child in a supine position; and a second configuration in which only a first portion of the mat is positioned flat with respect to the supporting surface and a second portion of the mat is positioned in a non-horizontal position with respect to the supporting surface, the first portion of the mat configured to receive the child in a seated position.

12. The child's gym of claim 11 wherein the mat is removably coupled to at least one of the first and second support members.

13. The child's gym of claim 11 wherein the mat has a first side and a second side, the first side of the mat facing the supporting surface in the first configuration, and a portion of the first side of the mat facing away from the supporting surface in the second configuration.

14. The child's gym of claim 11 wherein the first side of the mat includes at least one pocket configured for receiving objects, the at least one pocket being hidden from the child in the first configuration but exposed to the child in the second configuration.

* * * * *